US007716756B2

(12) United States Patent
Vultaggio

(10) Patent No.: US 7,716,756 B2
(45) Date of Patent: May 18, 2010

(54) SITE ASSEMBLED POOL

(76) Inventor: Richard Vultaggio, 220 Stage Rd., Vestal, NY (US) 13850

( * ) Notice: Subject to any disclaimer, the term of this patent is extended or adjusted under 35 U.S.C. 154(b) by 475 days.

(21) Appl. No.: 10/919,127

(22) Filed: Aug. 16, 2004

(65) Prior Publication Data

US 2006/0031983 A1 Feb. 16, 2006

(51) Int. Cl.
*E04H 4/00* (2006.01)

(52) U.S. Cl. ..... 4/506; 52/169.7

(58) Field of Classification Search ..... 4/496, 4/498, 503, 506; 52/169.7, 248, 300
See application file for complete search history.

(56) References Cited

U.S. PATENT DOCUMENTS 2,934,180 A * 4/1960 Hammitt et al. ..... 52/781
4,397,441 A * 8/1983 Manderla ..... 249/19
4,599,835 A * 7/1986 Rinke ..... 52/184
4,736,641 A * 4/1988 Reid ..... 74/103
4,974,266 A * 12/1990 Vultaggio et al. ..... 4/506
6,367,099 B1 * 4/2002 Contrino et al. ..... 4/506
6,412,122 B1 * 7/2002 Foy et al. ..... 4/506
6,729,097 B2 * 5/2004 Patel et al. ..... 52/665

* cited by examiner

*Primary Examiner*—Tuan N Nguyen
(74) *Attorney, Agent, or Firm*—Brown & Michaels, PC

(57) ABSTRACT

The present invention provides a site assembled swimming pool comprising a plurality of upstanding staves arranged in side by side relation and held together by upper and lower L-shaped rails, a coping extending entirely around and in releasably secured relation to the rails that fasten the upper edges of the staves together, and a flexible liner and cover releasably secured to the coping. The wooden staves include opposing vertical edges one of which includes a modified tongue and the other of which includes a groove. When assembled, the tongue of one stave engages the groove of the adjacent stave, thereby interconnecting the two staves.

8 Claims, 10 Drawing Sheets

SITE ASSEMBLED POOL

BACKGROUND OF THE INVENTION

1. Field of Invention

The present invention relates generally to swimming pools, and more particularly to pools having a flexible water containing liner composed of vinyl or the like surrounded by a support wall.

2. Description of Prior Art

Applicant's U.S. Pat. No. 4,974,266 describes a site-assembled swimming pool structure generally comprising a flexible liner supported by a surrounding wall of side-by-side wooden staves, wherein one vertical edge of each stave is convex and the other edge is concave. When the staves are arranged in side-by-side relation the convex edge of one stave nests in the concave edge of the adjacent stave. A plurality of cables pass entirely around the wall, and the cables are tensioned to urge the staves into tightly engaged relation. A downwardly facing U-shaped track member extends around the upper periphery of the wall and snugly engages the upper ends of the staves. The track member includes open channels formed on its opposing sides for releasably receiving bead portions of the pool liner (in the inwardly facing channel) and a removable cover (in the outwardly facing channel), respectively.

3. Objects and Advantages

In accordance with the foregoing objects and advantages, the present invention provides a site assembled swimming pool including a liner and cover attachment mechanism that is more easily manipulated than the state of the art.

It is a further object and advantage of the present invention to provide a site assembled swimming pool that may be constructed in various sizes and shapes.

It is another object and advantage of the present invention to provide a site assembled pool that may be leveled despite being positioned on an uneven surface.

It is an additional object and advantage of the present invention to provide a liner and cover attachment mechanism that includes aesthetically pleasing features incorporated therein.

Other objects and advantages of the present invention will in part be obvious and in part appear hereinafter.

SUMMARY OF THE INVENTION

In accordance with the foregoing objects and advantages, the present invention provides a site assembled swimming pool comprising a plurality of upstanding wooden (or PVC or other material) staves arranged in side by side relation, a coping extending entirely around and in releasably secured relation to the rails that fasten the upper edges of the staves together, and a flexible liner and cover releasably secured to the coping. The wooden staves include opposing vertical edges one of which includes a modified tongue and the other of which includes a groove. When assembled, the tongue of one stave engages the groove of the adjacent stave, thereby interconnecting the two staves. The size of a pool constructed in accordance with the present invention can vary. The staves are arranged in panels consisting of a predetermined number of staves which are interconnected to one another to form a pool (or other water containing vessel such as a whirlpool) having a desired shape, such as oval, rectangular, or circular. In assembling the pool, a plurality of panels are interconnected to one another with rails and bolts. A flexible joint cover is inserted between adjacent panels to provide closure to the wall formed by the panels. To provide effective sealing and to avoid pinching the liner between adjacent panels, the preferred joint cover includes a medial portion extending between the adjacent panels, an outer face that is positioned in contacting relation to the outwardly facing surface of the panels, and an inner face that is positioned in contacting relation to the inwardly facing surface of the panels. Other embodiments of joint covers are envisioned and disclosed herein.

Metal rails extend along the upper and lower edges of the panels and include portions that extend beyond the side edges of the end staves. The rails are securely affixed to the staves via fastening elements, such as screws that pass through the rails and into the staves. The extension portions include holes formed therethrough that permit passage of a fastener, and the extension portions of rails mounted on adjacent panels are positioned such that the holes formed through the respective extensions axially align with one another. A bolt may then be placed through the aligned holes and fastened with a nut, thereby securely interconnecting adjacent panels. The bottom bolt permits vertical adjustments to be made to the rails, and hence to the panels, thereby permitting leveling of the pool's panels as the pool is constructed.

Once adjacent panels are securely interconnected, the flexible joint cover is inserted between the end staves. A generally U-shaped coping is then positioned on the upper edge of the upper rail member. The coping includes a pair of legs that define a space therebetween. The space is engaged by the outside edge/upper edges of the rail and securely interconnects the coping to the upper rail and panels. A channel is formed in the inwardly facing wall of the coping that is adapted to receive the bead portion of a flexible pool liner therein. A flange formed in the channel engages the tooth of the bead to prevent the bead from becoming accidentally dislodged from the channel. A second channel is formed in the upper surface of the coping for receiving the bead portion of a flexible pool cover. This second channel also includes a flange that engages the tooth formed on the cover's bead portion to prevent inadvertent dislodging of the cover. When a cover is not used on the pool, a removable cover strip lockingly engages the channel and lies flush with the top of the coping, thereby presenting a visually pleasing coping (the top of the coping appears unitary as the channel is hid by the cover strip.) In addition, third and fourth channels are formed in the inwardly and outwardly facing walls of the coping to receive aesthetic strips therein. The aesthetic strips could be, for example, extruded strips of colored plastic or fiber optic lighting that provide an illuminating strip. The aesthetic strips snap engage the channels.

BRIEF DESCRIPTION OF THE DRAWINGS

The present invention will be more fully understood and appreciated by reading the following Detailed Description in conjunction with the accompanying drawings, in which:

FIG. 3E is a cross-sectional plan view of a portion of adjacent staves illustrating the modified tongue and groove;

DETAILED DESCRIPTION

Figure 1:
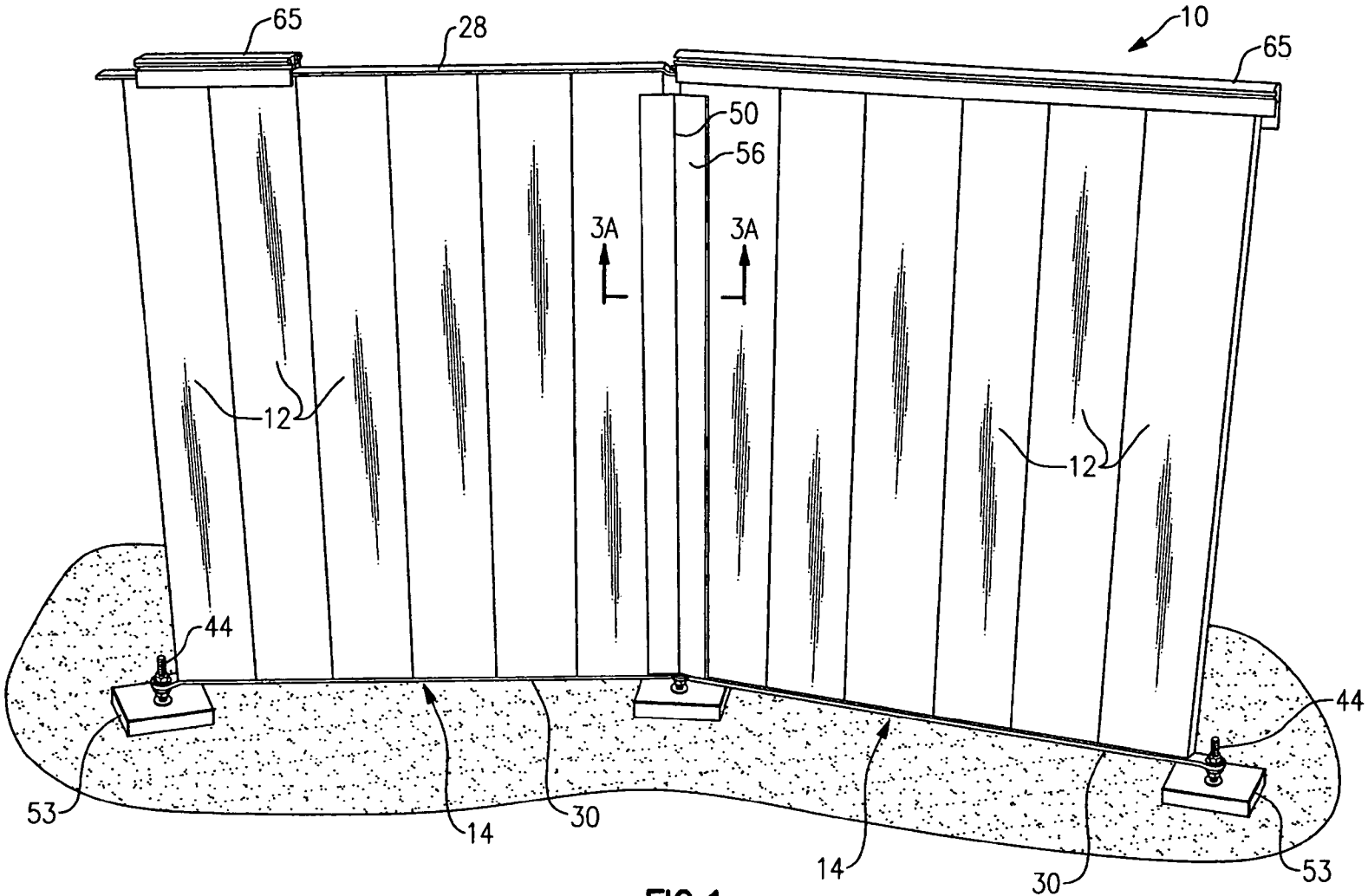
FIG. 1 is an interior perspective view of a portion of a pool's support walls.
Figure 2:
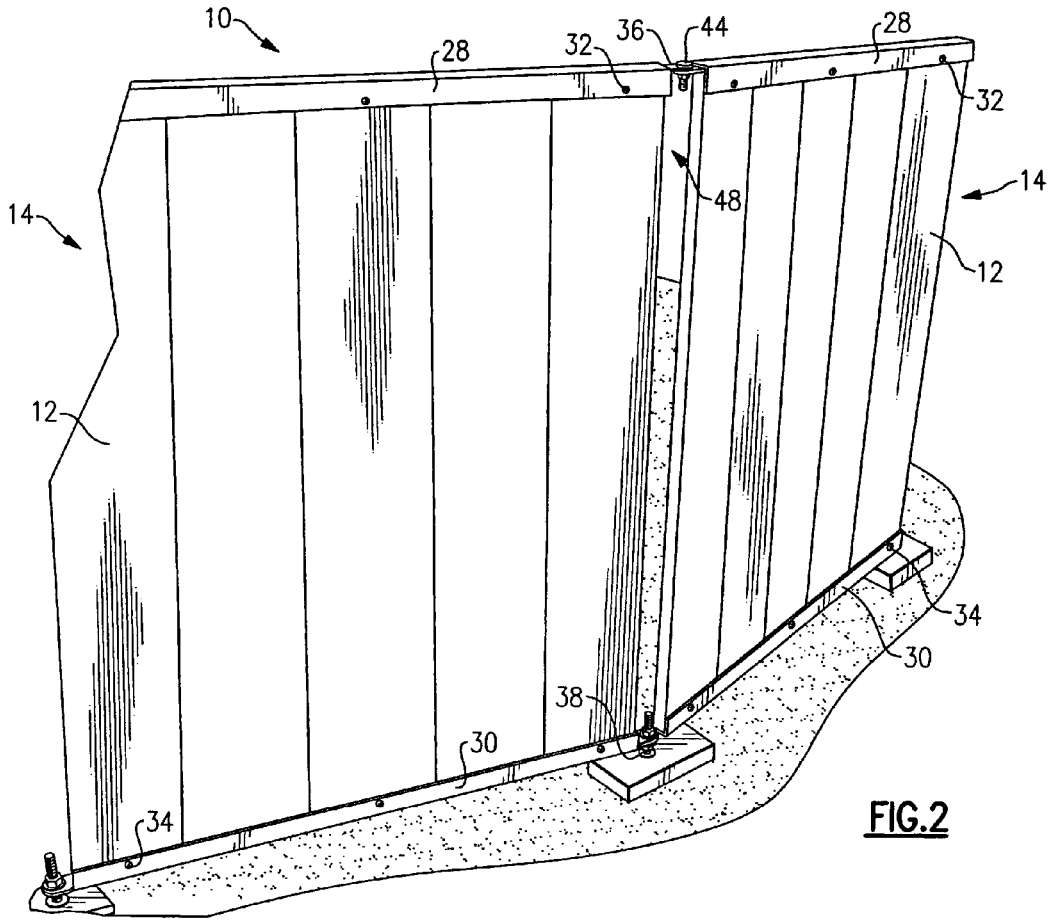
FIG. 2 is an exterior perspective view of a portion of a pool's support walls.

Referring now to the drawings, in which like reference numerals refer to like parts throughout, there is seen in FIG. 1 a portion of a site assembled pool, designated generally by reference numeral 10, comprising a plurality of staves 12 that form a support wall for the pool. As used herein, "pool" can refer to any water containing vessel, such as a swimming pool or whirlpool, for example. Staves 12 are conjoined in side by side relation to form panels 14, and the panels are interconnected to one another to form the swimming pool's support wall. A conventional flexible liner 16 is interconnected to panels 14, as will be described in greater detail hereinafter, to contain water in the pool, and a conventional flexible cover 18 can also be interconnected to panels 14 in a manner to be described hereinafter to provide a solar or weather cover for the pool.

Figure 3A:
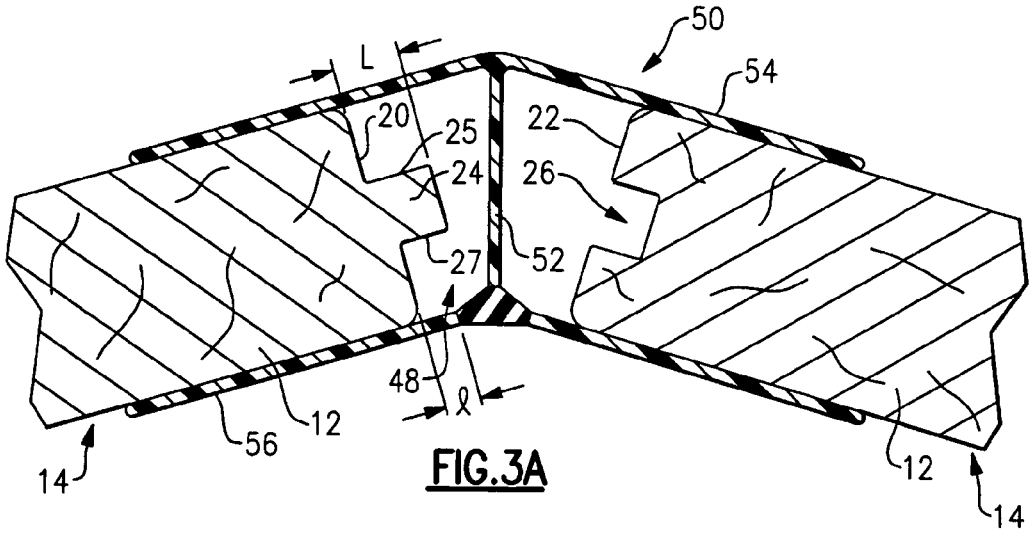
FIG. 3A is a cross-sectional plan view of a preferred embodiment of adjacent staves and a joint cover.

Staves 12 include opposing vertical edges 20, 22 that include a modified tongue 24 and groove 26, respectively (See FIG. 3A). In assembling panels 14, staves 12 are arranged in side by side relation with tongue 24 of one stave engaging or nesting within groove 26 of an adjacent stave. Once the predetermined number of staves 12 are arranged in side by side relation to form panel 14, an L-shaped top rail 28 is mounted over the top edges of the staves and an L-shaped bottom rail 30 is mounted to the bottom edges of staves 12. Fasteners 32, 34, such as the illustrated screws, pass through rails 28, 30, respectively, and into staves 12, thereby securely connecting the rails to the staves.

Figure 3B:
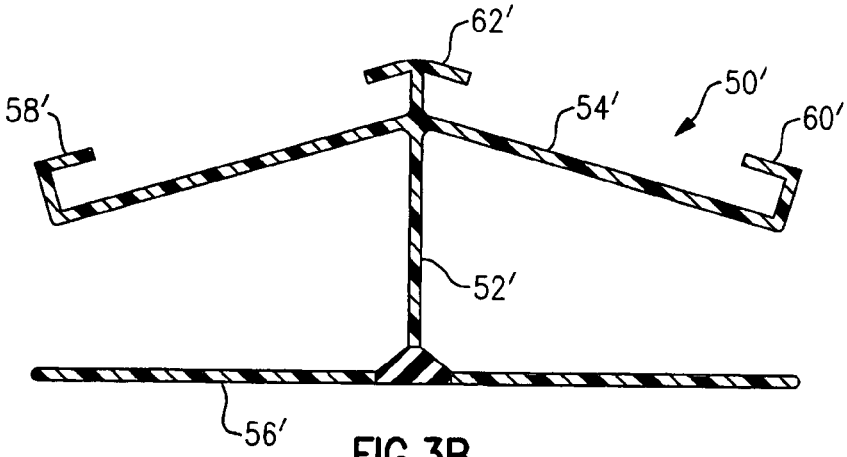
FIGS. 3B and 3C are cross-sectional plan views of an alternate embodiment of the joint cover.
Figure 3C:
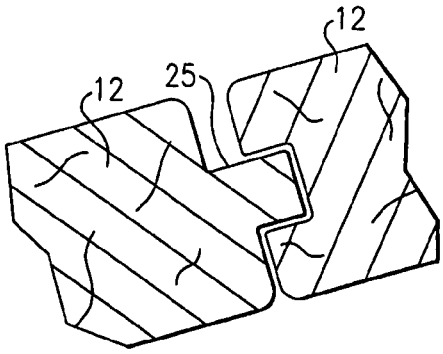
Figure 3C:
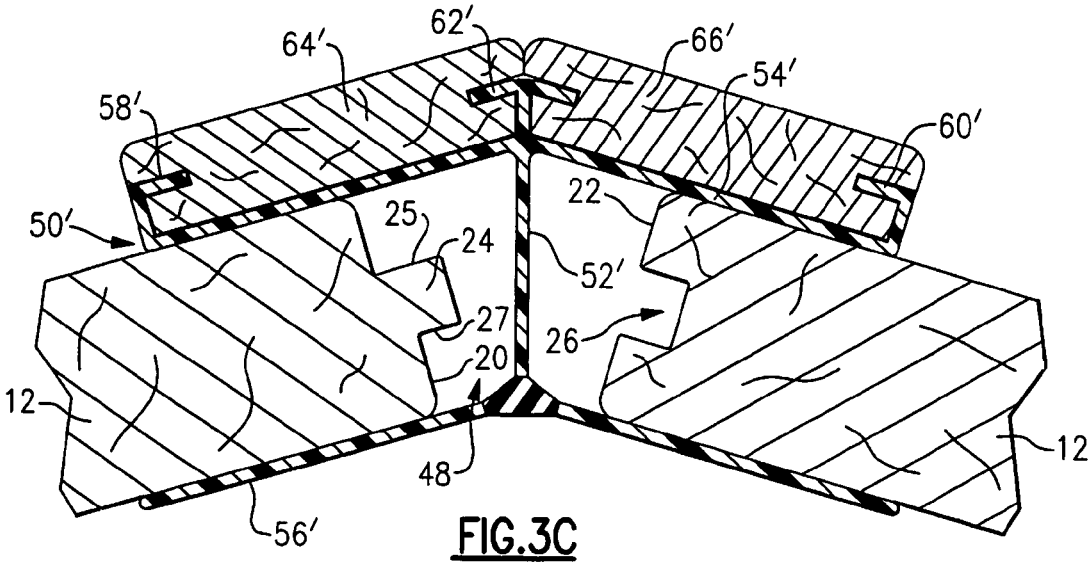
Figure 3D:
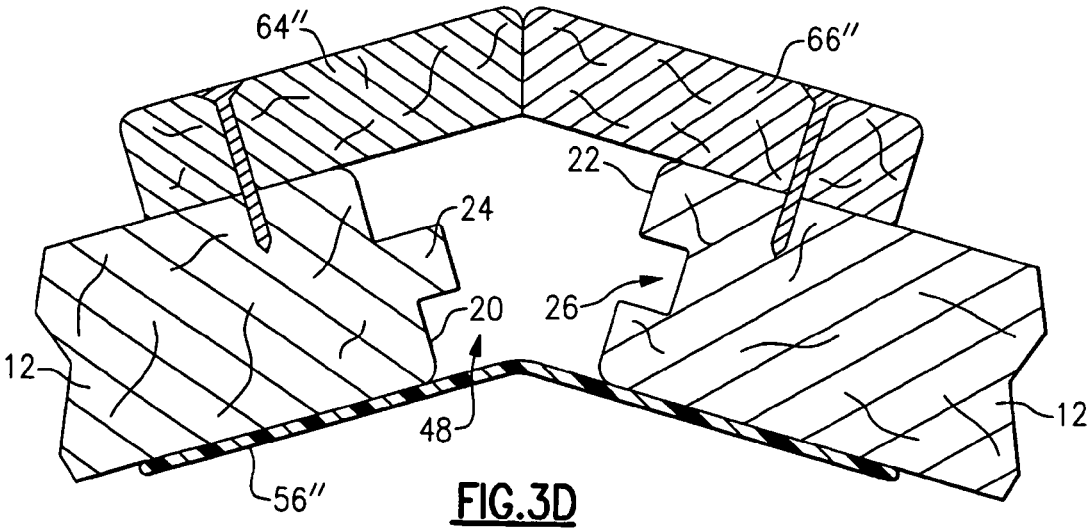
FIG. 3D is a cross-sectional plan view of a second alternate embodiment of the joint cover.
Figure 4:
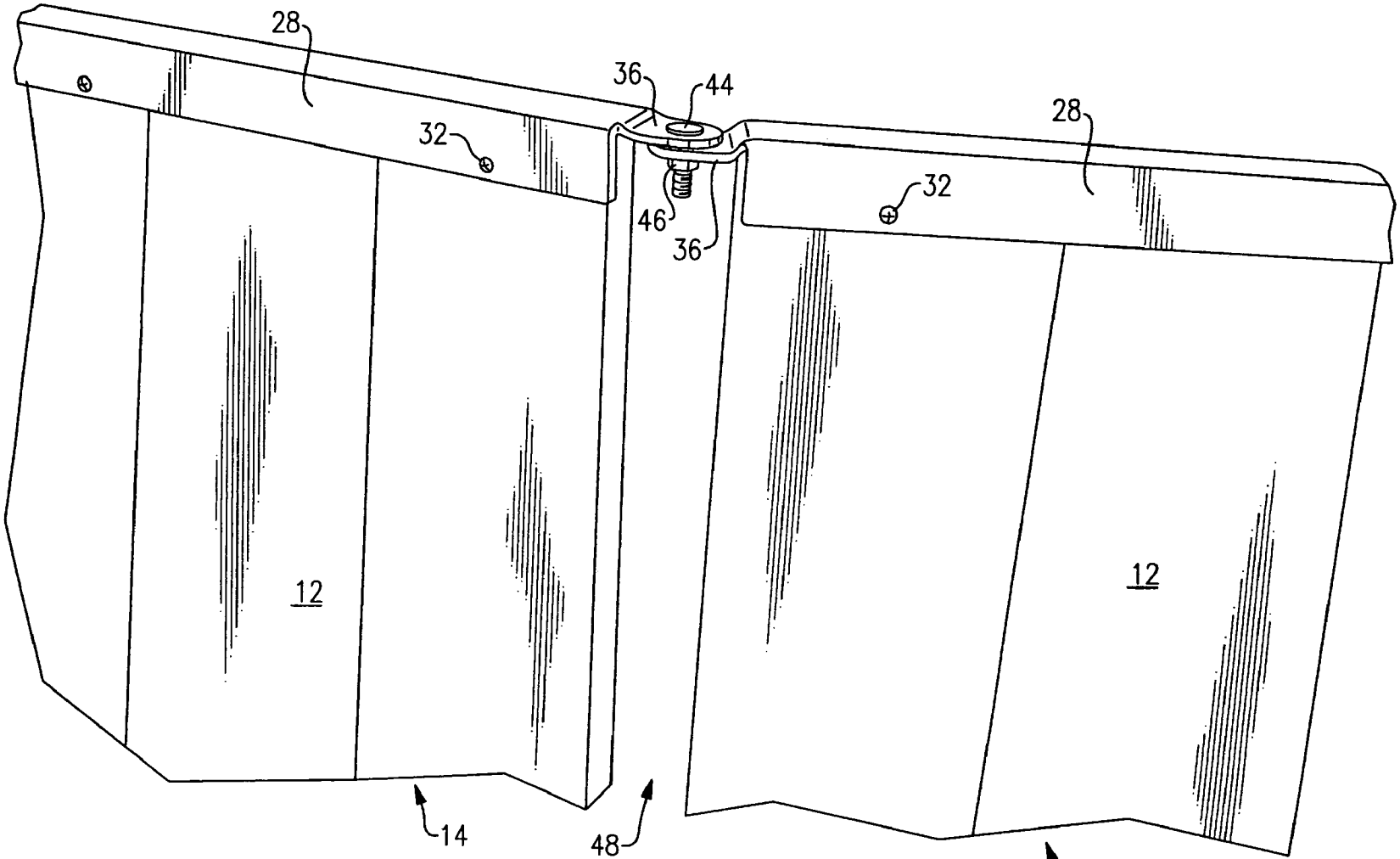
FIG. 4 is a partial perspective view of the upper edges of adjacent panels of staves.

As previously mentioned and as illustrated in FIGS. 3A, 3C, and 3D, tongue 24 is modified in that its outwardly facing edge 25 is longer (length L) than its inwardly facing edge 27 (length l). With reference to FIG. 3E, the reason for the offset is to provide a gap between the outer edge of adjacent staves 14 with a gap. Due to the potential crooking that occurs with wooden staves, if tongue 24 was conventional, there would be portions of the outer edges of adjacent staves 14 that would contact and other portions that did not contact groove 26, thereby creating an aesthetically displeasing seam between adjacent seams. By providing a gap that cannot be closed due to the offset, the visual perception of adjacent boards will always be that the gap exists, even if the gap is slightly larger in certain regions of the staves than in others.

Top rails 28 and bottom rails 30 each include projecting portions 36, 38, respectively, that extend outwardly beyond the end staves 12 in each panel 14. Projecting portions 36, 38 each include a respective opening formed therethrough, and each extends in a plane slightly offset from the plane in which the edge of the rails extend. To interconnect a pair of panels 14 together, the openings of the projecting portions 36 and 38 of one panel 14 are axially aligned with the openings of the projecting portions 36 and 38 of those extending from the adjacent panel 14. A bolt 44 or similar fastener is then passed through the aligned openings and secured with a nut 46. Securing adjacent panels 14 together in this manner creates a gap 48 between the panels 14 that is approximately twice the width of one of the projecting portions 36, 38.

Figure 5:
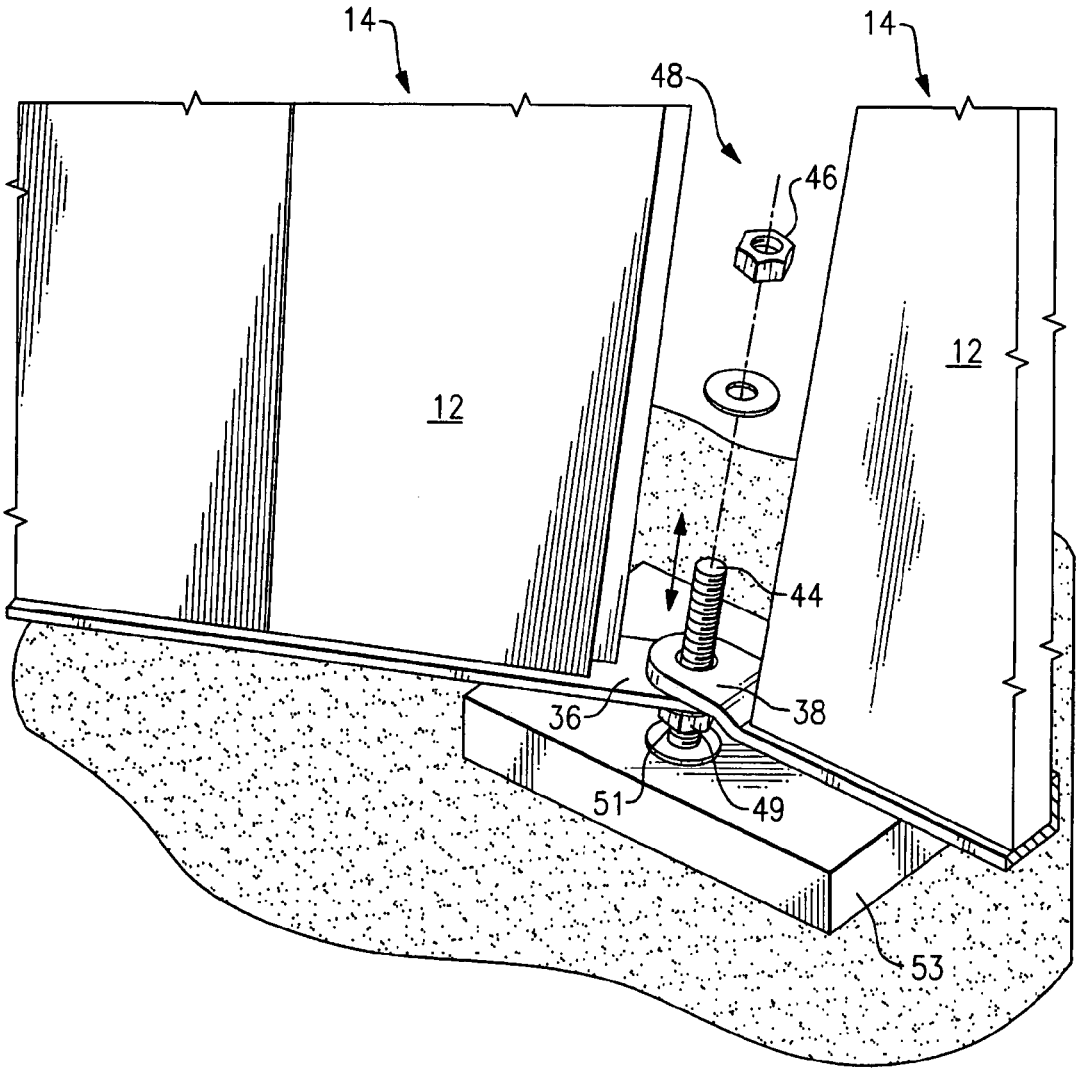
FIG. 5 is a partial perspective view of the lower edges of adjacent panels of staves, further illustrating the adjustable nature of the bolt interconnecting the two panels.
Figure 6:
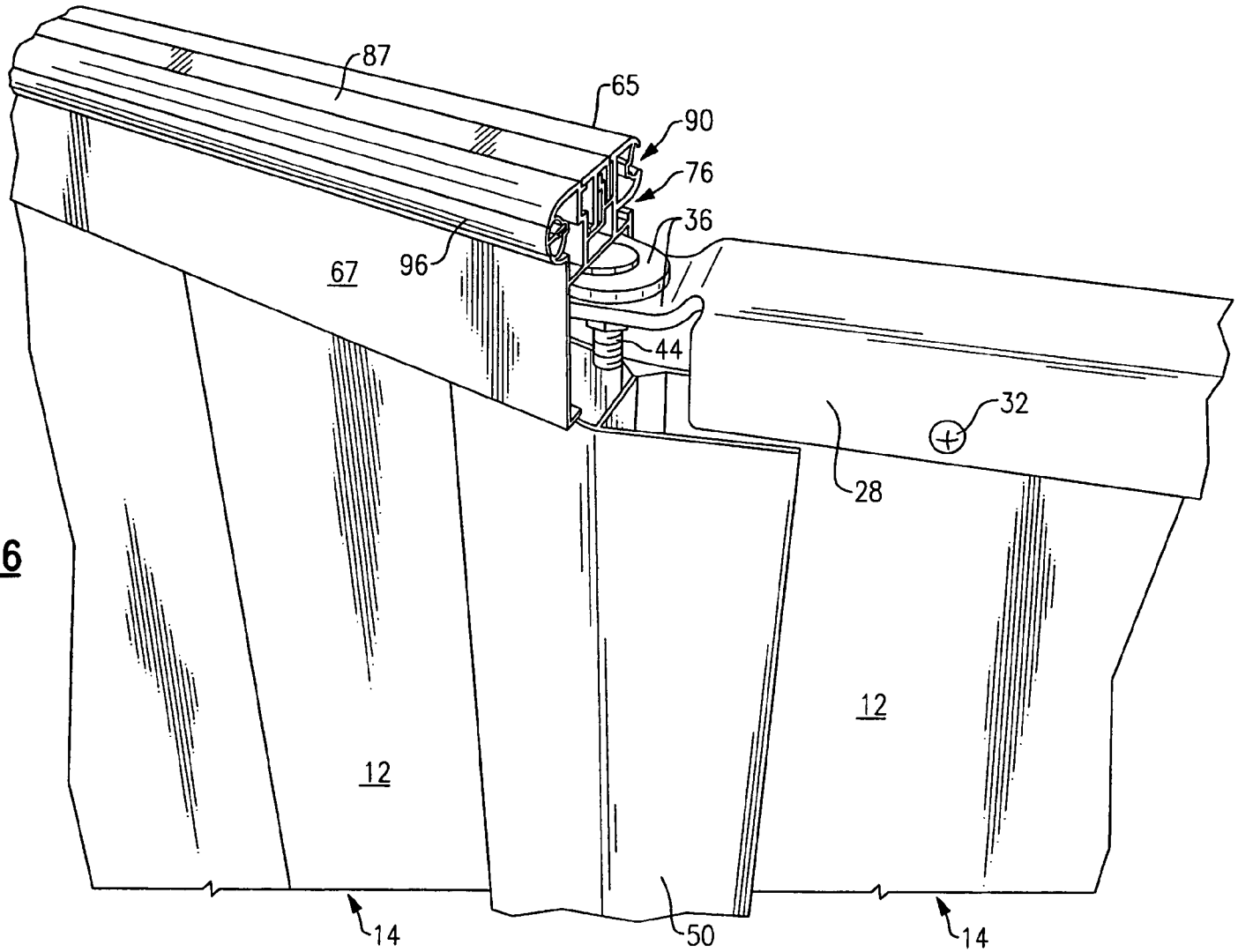
FIG. 6 is a partial perspective view of the upper edges of adjacent panels of staves and a coping positioned over one of the panel's upper edge and a joint cover disposed between the panels.
Figure 7:
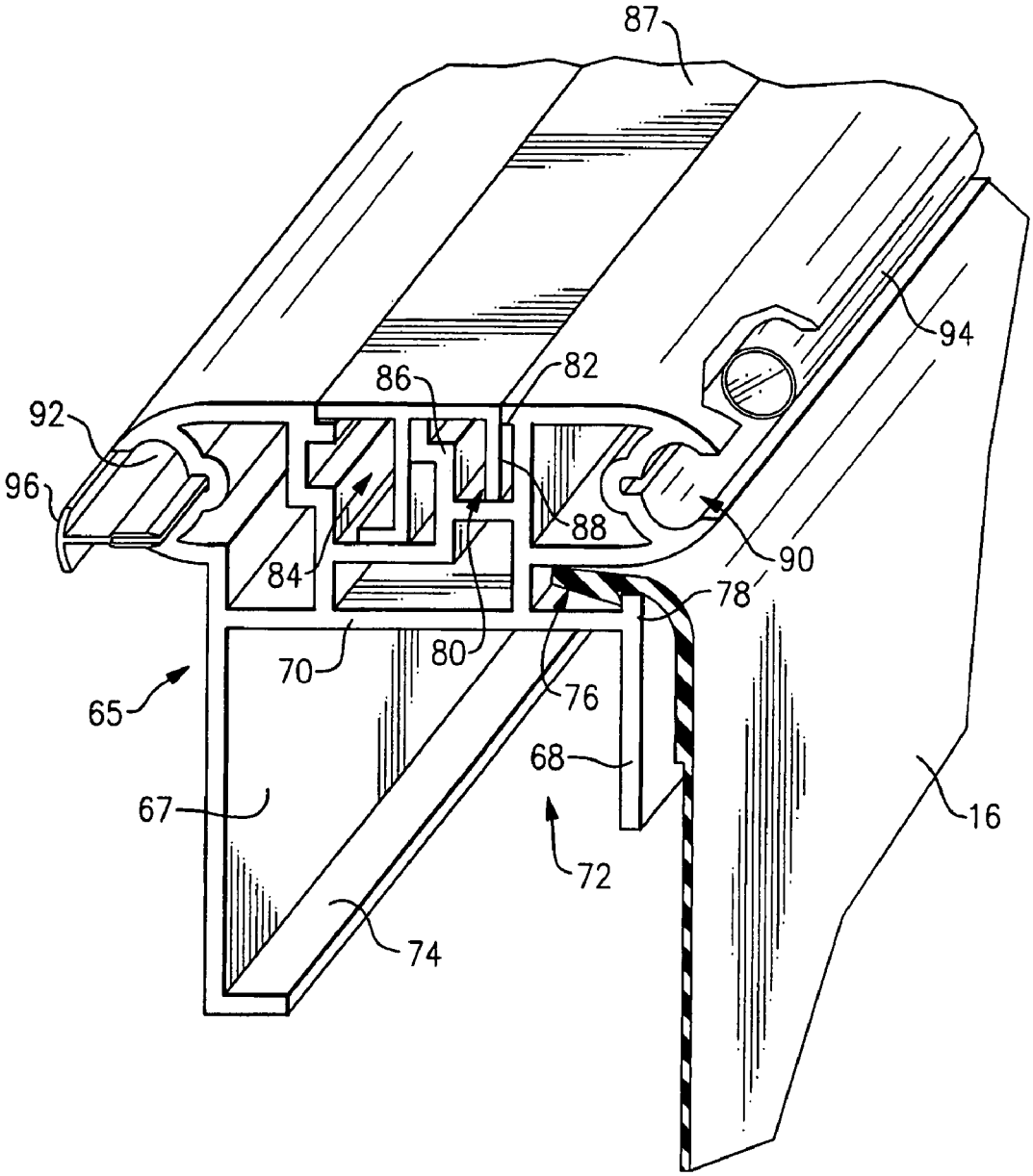
FIG. 7 is a partial perspective view of the coping and a pool liner interconnected thereto.
Figure 8:
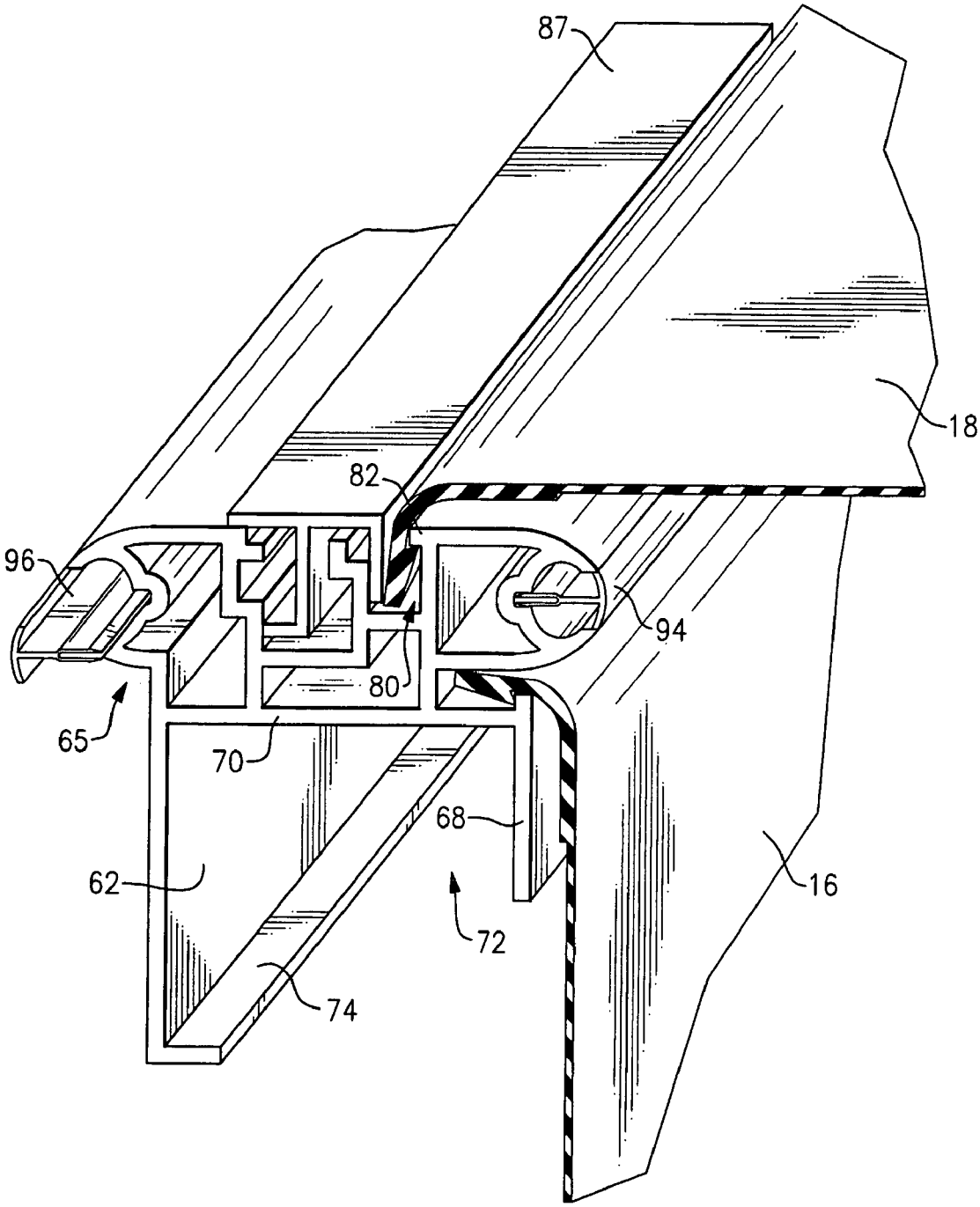
FIG. 8 is a partial perspective view of the coping and a pool liner and pool cover interconnected thereto.

The bolt 44 that passes through openings in the bottom projections 38 is vertically adjustable as illustrated by the arrow in FIG. 5 via a nut 49 that may be threadably advanced along the length of bolt 44 beneath projections 38. In addition, the head 51 of bottom bolt 44 is flat so that it may lie flat on a concrete block 53. When each successive panel 14 is connected to an adjacent panel, the bottom bolts 44 interconnecting the panels can be vertically adjusted to ensure that they are level. By leveling each panel 14 during the construction phase, pool 10 will be level when complete, and blocks 53 do not have to be level relative to one another.

To eliminate gap 48 that exists between adjacent panels 14, thereby preventing liner 16 from slipping therethrough, a joint cover 50 is used. Joint cover 50 includes a medial portion 52 that extends between adjacent panels 14, an outer face 54 that conforms to and contacts the outer surface of the end staves 12 of adjacent panels 14, and an inner face 56 that conforms to and contacts the inner surface of the end staves 12 of adjacent panels 14. Joint cover 50 is preferably composed of a PVC or other semi-rigid plastic that permits its flexure around obstacles, but provides enough rigidity to effectively seal gap 48.

An alternate embodiment of a joint cover 50' is illustrated in FIGS. 3B and 3C. Joint cover 50' includes all the features of joint cover 50, but further includes a series of flanges 58', 60', and 62' extending from the opposing ends of outer face 54' and medial portion 52', respectively. Flanges 58', 60', and 62' engage wooden boards 64', 66' that extend the length of staves 12 and cover the outwardly facing portions of joint cover 50', thus creating as aesthetically pleasing exterior view of the pool 10.

A further embodiment of joint cover 50 is illustrated in FIG. 3D with joint cover 56". Joint cover 56" is secured to and covers the gap between the inwardly facing surface of adjacent staves 12. Unlike joint cover 50 and 56', joint cover 56" does not extend into the gap that exists between the adjacent staves. Instead, a pair of wooden boards 64", 66" are securely attached to the outwardly facing surface of respective ones of the adjacent staves 12, with each board covering approximately half of the gap that exists between the staves. Screws 67", or equivalent fastening elements, can be used to interconnect boards 64", 66" to staves 12. As with boards 64', 66', boards 64", 66", create an aesthetically pleasing exterior view of the pool.

Once panels 14 are assembled with rails 28, 30, a coping 65 is attached to the upper ends of rails 28 (and hence staves 12.) Coping 65 includes a pair of legs 67, 68 held in spaced parallel relation to one another by a cross member 70 and that define a downwardly facing groove 72 therebetween. Leg 67 includes a narrow flange 74 extending inwardly therefrom. Coping 65 is attached to rails 28 by placing it over the rail with flange 74 snap engaging the bottom edge of rail 28. Coping 65 is composed of PVC or an equivalent material that permits some flexure of the material while providing the necessary structural rigidity to achieve its purposes.

Coping 65 further includes a first channel 76 formed in its inwardly facing side surface and partially defined by cross member 70 (defining the bottom of the channel) and leg 68 (defining the leading edge of the channel). First channel 76 includes a narrow, upwardly extending flange 78 formed by leg 68 at its leading edge. Channel 76 is adapted to receive the bead portion of liner 16 therein with flange 78 preventing inadvertent dislodgement of the bead portion.

Coping 65 further includes a second channel 80 formed in its upper surface that includes a horizontally extending, narrow flange 82 formed along its forward edge. Channel 80 is adapted to receive the bead portion of cover 18 therein with flange 82 preventing inadvertent dislodgement of the bead.

A third channel 84 is formed in the upper surface of coping 68 adjacent to channel 80 (wall 86 dividing channel 80 from channel 84). Channel 84 removably receives a strip 87 therein. Strip 87 includes a downwardly extending leg 88 that engages channel 80 and pinches and retains cover 18 in secure position within channel 80, or simply encloses the channel if no cover is in place.

Fourth and fifth channels 90, 92 are respectively, longitudinally formed along the opposing side edges of coping 68. Channels 90, 92 receive ornamental strips 94, 96 therein, respectively. Strips 94,96 can be colored plastic, fiber optic lighting strips, or other ornamentally decorated strip.

Figure 9:
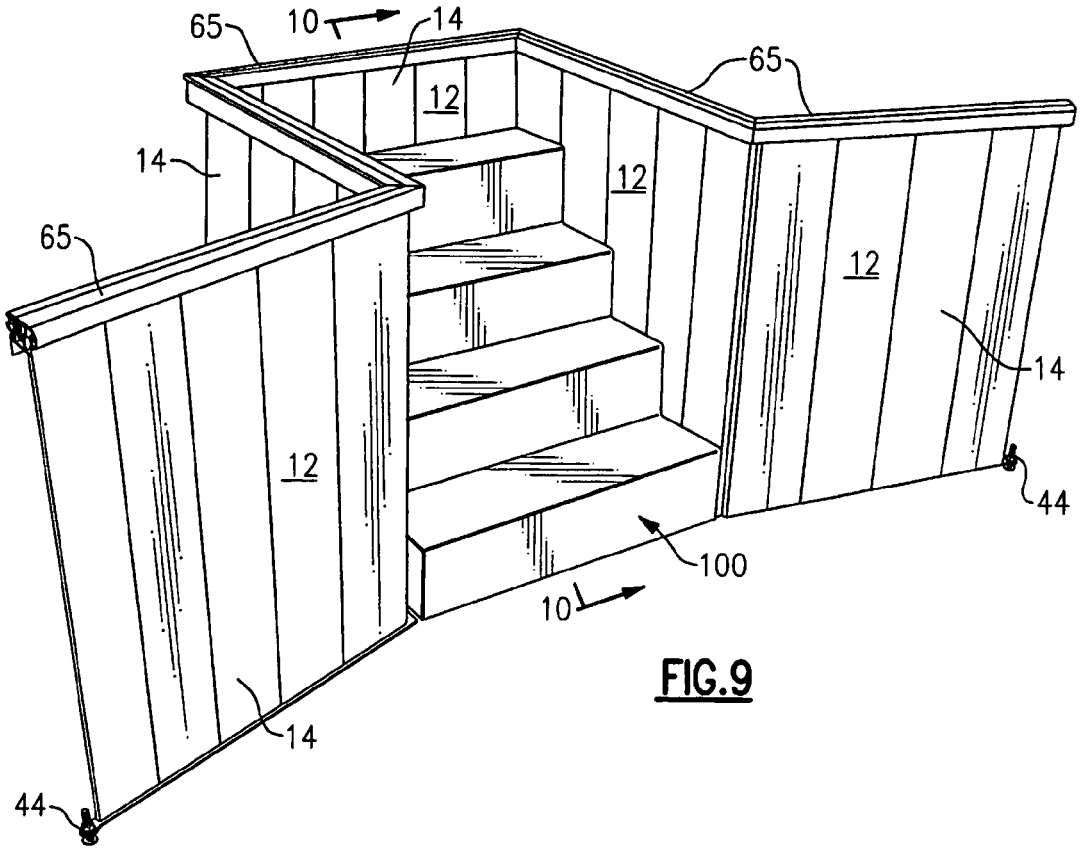
FIG. 9 is a perspective view of stairs that may be incorporated into the pool of the present invention.
Figure 10:
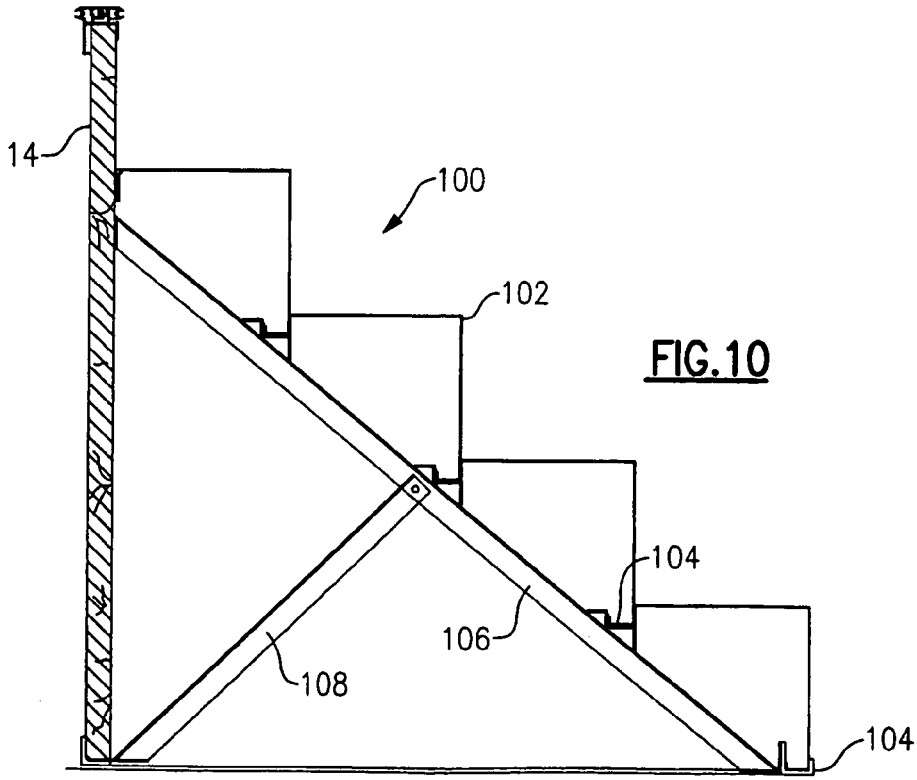
FIG. 10 is a cross-sectional view of the stairs taken along section line 10-10 of FIG. 9.

Referring now to FIGS. 9 and 10, a set of stairs, generally designated by reference numeral 100, can be incorporated into pool 10. Stairs 100 include a series of three support walls 14 that define the space, typically rectangular, in which stairs 102 are positioned (it is within the scope of the present invention that more than three support wall may be needed depending on the shape and size of the stairs, and three is only used as exemplary of the invention.) Stairs 102 include reinforcing brackets 104 that fix them to a support stringer 106 that extends diagonally from the bottom-most stair to the rear support wall. An additional brace 108 extends diagonally from the base of the rear support wall 14 to the approximate middle of support stringer 106. Support stringer 106 and brace 108 are necessary to support the weight and pressure created by the water filling pool 10.

What is claimed is:

1. A site assembled pool, comprising:

a plurality of panels, each panel comprising:

a plurality of elongated staves arranged side by side, each stave having upper and lower ends, inwardly and outwardly facing side major surfaces, and first and second opposing side edges extending between the major surfaces;

a top rail comprising a top stave-retaining portion that maintains the upper ends of the staves, a first top projecting portion extending from a first end of the panel and having a first top opening for receiving a top fastener, and a second top projecting portion extending from a second end of the panel opposite the first end and having a second top opening that axially aligns with the first opening from a top rail of an adjacent panel for receiving the top fastener; and a bottom rail comprising a bottom stave-retaining portion that supports the lower ends of the staves, a first bottom projecting portion extending from the first end of the panel and having a first bottom opening for receiving a bottom fastener, and a second bottom projecting portion extending from the second end of the panel and having a second bottom opening that axially aligns with the first opening from a bottom rail of an adjacent panel for receiving the bottom fastener;

a plurality of top fasteners, the top fasteners connecting top projecting portions of adjacent panels through the first and second top openings of adjacent panels; and a plurality of bottom fasteners, the bottom fasteners connecting bottom projecting portions of adjacent panels through the first and second bottom openings of adjacent panels;

wherein each panel is fastened to adjacent panels.

2. The site assembled pool of claim 1, further comprising a series of steps incorporated therein.

3. The site assembled pool of claim 1, wherein at least one of the bottom fasteners comprises:

a bolt passing through the bottom openings of adjacent bottom rails; and at least one nut vertically adjustable on the bolt and on which the bottom projecting portions of adjacent bottom rails rest;

wherein adjusting a height of the nut with respect to the leveling bolt adjusts a height of the bottom projecting portions and a height of the bottom projecting portions for leveling the panels.

4. The site assembled pool of claim 1, wherein the site assembled pool is a structure selected from the group consisting of a swimming pool and a whirlpool.

5. The site assembled pool of claim 1 further comprising:

a plurality of copings, the copings being mounted to the top rails of the panels, each coping having a liner channel; and the liner for containing water in the pool, the liner comprising a bead portion mounted in the liner channels of the copings.

6. The site assembled pool of claim 5, wherein the copings engage the top rails such that the copings are securely interconnected to the upper rails.

7. The site assembled pool of claim 1 further comprising a plurality of joint covers, each joint cover being inserted into a gap between adjacent panels.

8. A site assembled pool, comprising:

a plurality of panels, each panel comprising:

a support wall having upper and lower ends and inwardly and outwardly facing side major surfaces;

a top rail comprising a top wall-retaining portion that maintains the upper end of the support wall, a first top projecting portion extending from a first end of the panel and having a first top opening for receiving a top fastener, and a second top projecting portion extending from a second end of the panel opposite the first end and having a second top opening that axially aligns with the first opening from a top rail of an adjacent panel for receiving the top fastener; and a bottom rail comprising a bottom wall-retaining portion that supports the lower end of the support wall, a first bottom projecting portion extending from the first end of the panel and having a first bottom opening for receiving a bottom fastener, and a second bottom projecting portion extending from the second end of the panel and having a second bottom opening that axially aligns with the first opening from a bottom rail of an adjacent panel for receiving the bottom fastener;

a plurality of top fasteners, the top fasteners connecting top projecting portions of adjacent panels through the first and second top openings of adjacent panels; and a plurality of bottom fasteners, the bottom fasteners connecting bottom projecting portions of adjacent panels through the first and second bottom openings of adjacent panels;

wherein each panel is fastened to adjacent panels.

* * * * *